United States Patent [19]

Kay et al.

[11] Patent Number: 4,874,117

[45] Date of Patent: Oct. 17, 1989

[54] MANUALLY-OPERATED FLUID DISPENSER AND ASSOCIATED CLOSURE CAP

[75] Inventors: Nathan Kay, Encino; Donald W. McNab, Long Beach; Edward J. Moya, San Gabriel, all of Calif.

[73] Assignee: Photofinish Cosmetics Inc., Encino, Calif.

[21] Appl. No.: 194,840

[22] Filed: May 17, 1988

[51] Int. Cl.[4] ..... B67D 3/00

[52] U.S. Cl. ..... 222/487; 222/383; 222/384; 222/385; 222/386; 222/387; 222/391; 222/484; 222/562; 401/176; 401/179; 401/181; 401/66; 220/326

[58] Field of Search ..... 222/383–387, 222/562, 391, 484, 487; 401/176, 179, 181, 66; 220/326, 315

[56] References Cited

U.S. PATENT DOCUMENTS

| | | | |
|---|---|---|---|
| 1,795,684 | 9/1927 | Seele | 222/487 |
| 4,157,774 | 6/1979 | Micallef | 222/321 |
| 4,664,301 | 5/1987 | Hoyt | 222/538 |

FOREIGN PATENT DOCUMENTS

| | | | |
|---|---|---|---|
| 2917543 | 8/1979 | Fed. Rep. of Germany | 401/176 |

*Primary Examiner*—Joseph J. Rolla
*Assistant Examiner*—Boris Milef
*Attorney, Agent, or Firm*—Cohen, Pontani & Lieberman

[57] ABSTRACT

A manually-operated dispenser for user-controlled discharge of an internally-stored fluid includes a variable length assembly normally driven to its maximum longitudinal extension for fluid-tightly closing a fluid discharge opening and a vent opening disposed at opposite ends of an elongated housing, a piston bounding an end of an internal fluid reservoir and operatively movable along the housing for volumetrically reducing the reservoir and for driving stored fluid toward and through the discharge opening, and an actuator assembly manually operable by the user for causing controlled foreshortening of the variable length assembly whereby the fluid discharge and vent openings are concurrently opened permitting the forced discharge of a correspondingly controlled volume of stored fluid. An associated dispenser end closure cap incorporates a movable shuttle assembly for protectively receiving and substantially fluid-tightly enclosing an applicator integrally carried on the dispenser when the cap is operably emplaced on the dispenser for storage between fluid discharging uses thereof.

38 Claims, 6 Drawing Sheets

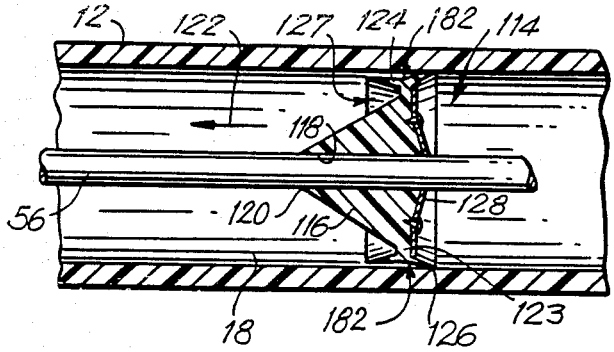
FIG. 10
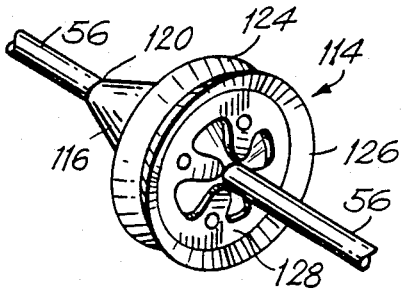
FIG. 11
FIG. 14
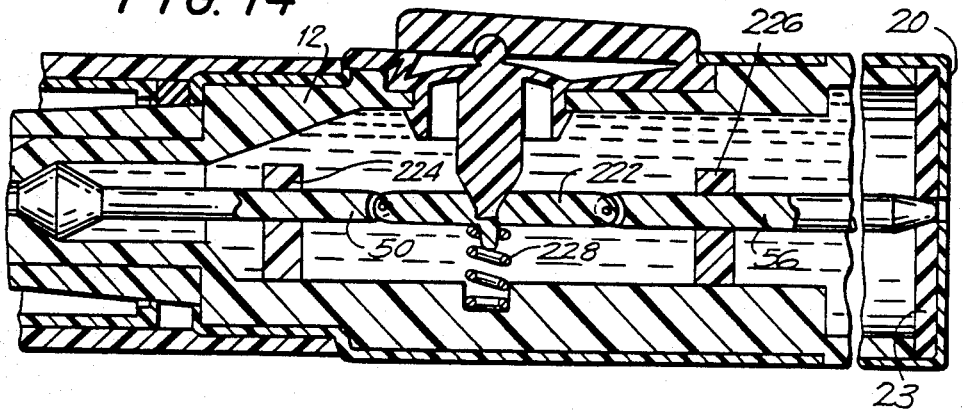
FIG. 15
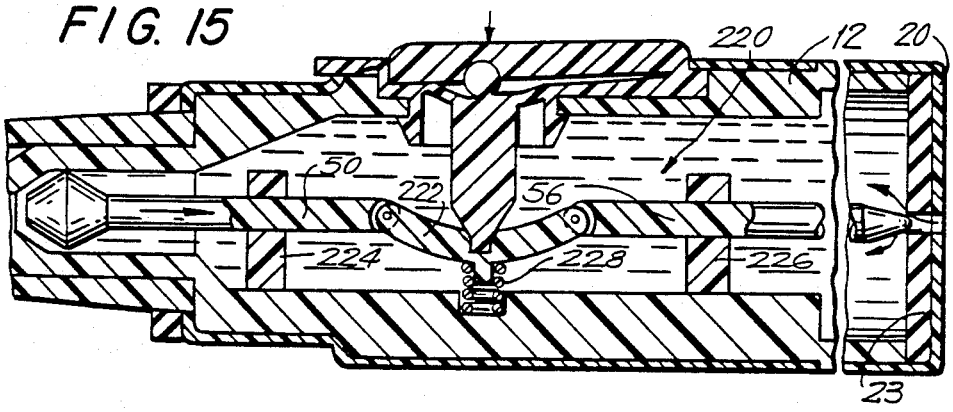

MANUALLY-OPERATED FLUID DISPENSER AND ASSOCIATED CLOSURE CAP

FIELD OF THE INVENTION

The present invention relates to fluid dispensers, and more particularly to manually-operated dispensers for discharging a preferably controllable volume of fluid from an internal reservoir. The invention is further directed to a closure cap for cooperative and protective releasable mounting on a fluid-discharge end of the dispenser.

BACKGROUND OF THE INVENTION

Numerous constructural arrangements implementing manually-operated dispensers for discharging a quantity of fluid from an internal storage reservoir are known in the art. Such dispensers have been employed in a variety of applications, and for discharging many types of fluids in gaseous, liquid and flowable plastic states. Dispensers intended for sale to and use by consumers for discharging a cosmetic fluid onto an integral applicator when actuated by such a user comprise a particularly common application for dispensers of this kind.

Cosmetic fluid dispensers for manual user operation must be capable of relatively inexpensive fabrication from readily available materials. While it is important to minimize manufacturing costs, however, such dispensers must generally be fabricated to close tolerances to insure proper fit and cooperative interengagement between both fixed and relatively moveable parts and, further, to provide for reliable operation of the dispenser throughout its intended useful life—most typically until the initial supply of stored fluid is exhausted. Assuring continued operative reliability is made more difficult by the often hostile characteristics of the specific cosmetic fluids being stored and dispensed such as, for example, nail enamels which are relatively caustic to many common construction materials and which quickly thicken and harden in the absence of adequate fluid-tight seals bounding those portions of the dispenser exposed to or containing the dischargable fluid. Many heretofore known and commercially implemented dispenser constructions employ relatively complex mechanical designs which incorporate large numbers of mutually engaging parts that must all cooperatively interact for successful operation of the device. Dispenser constructions of this type are difficult and expensive to fabricate and often suffer an unusually high failure rate as the devices approach the end or latter portion of their intended useful lives. The aesthetic appearance of known dispensers—which is not uncommonly a significant and important part of their allure to the consumer at the point of sale—also often declines significantly from their pre-sale condition as the devices are repeatedly used, becoming less and less attractively appealing to the user. Soiling of the user's hands is also a not atypical problem as the discharged fluid, after repeated actuations of the dispenser, begins to cover exposed portions of the fluid-discharge end of the device and to leak onto and within an associated closure cap.

It is accordingly a desideratum of the invention to provide a manually-operable dispenser for discharging an internally-stored fluid. It is a particular object of the invention to provide such a dispenser which overcomes the deficiencies and drawbacks of prior art devices.

It is another object of the invention to provide such a dispenser which is operable for discharging a user-controllable volume of stored fluid.

It is a further object of the invention to provide such a dispenser which features enhanced reliability of operation through fabrication using only a minimum number of relatively movable parts.

It is yet another object of the invention to provide such a dispenser of particularly attractive aesthetic appearance that is maintained even after numerous fluid-discharging actuations and throughout its intended useful life.

Still another object of the invention is to provide a closure cap for such a dispenser which is cooperatively constructed for protectively enclosing an applicator integrally carried on the dispenser.

A further object of the invention is to provide such a dispenser that may be constructed of readily available materials at economically-favorable costs.

BRIEF DESCRIPTION OF THE DRAWINGS

In the drawings, wherein similar reference characters denote similar elements throughout the several views:

FIG. 10 is an elevated sectional side view of a unidirectionally movable piston in accordance with the invention;

FIG. 11 is an elevated rear perspective view of the piston of FIG. 10;

FIG. 14 is an elevated sectional side view, partially broken away, of another alternate form of a variable length assembly in accordance with the invention in its unactuated condition; and FIG. 15 is an elevated sectional side view, partially broken away, of the variable length assembly of FIG. 14 shown in its actuated condition.

DETAILED DESCRIPTION OF THE PREFERRED EMBODIMENTS

Figure 1:
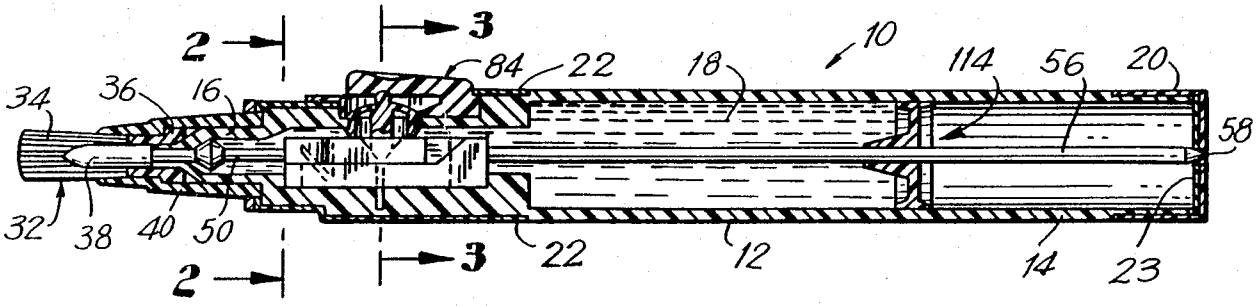
FIG. 1 is an elevated sectional side view of a preferred embodiment of fluid dispenser constructed in accordance with the teachings of the present invention.
Figure 3:
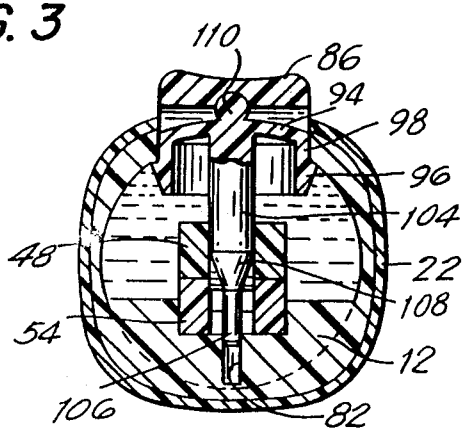
FIG. 3 is a cross-sectional view taken along the lines 3—3 in FIG. 1.
Figure 2:
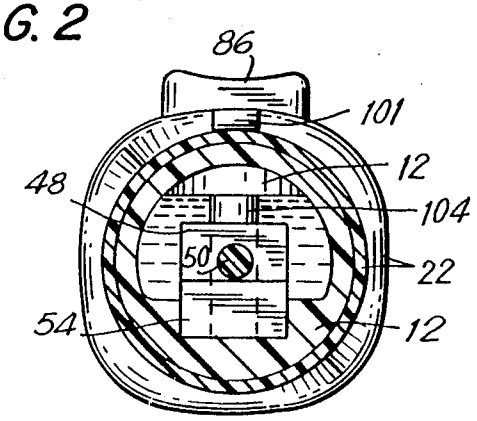
FIG. 2 is a cross-sectional view taken along the lines 2—2 in FIG. 1.

Turning now to the drawings, a currently preferred embodiment of an improved fluid dispenser and associated end closure cap constructed in accordance with the present invention for manually-effected, operator-controlled discharge of a stored fluid is illustrated in FIGS. 1 through 11. At the outset, it should be pointed out and understood that, as employed in this disclosure, the term "fluid" is intended to include any flowable material whether in a gaseous, liquid or reasonably flowable plastic state. The dispenser of the present invention has wide application for the storage and discharge of such flowable materials and may be readily adapted for use with a particular fluid by a person of ordinary skill in the art having knowledge of this disclosure and teaching.

The inventive dispenser which is identified in the drawings by the general reference numeral 10, includes an elongated housing 12 of generally tubular construction and which extends from a rear or distal end 14 to a generally tapered forward end 16 from which, as will hereinafter be described, fluid is operatively discharged onto a depending applicator 32. Housing 12 contains and defines an internal space or chamber or reservoir 18 within which is stored a fluid for operator-controlled discharge from dispenser 10. The dispenser of the invention may be utilized for storing and selectively discharging almost any desired fluid and is especially well adapted for use with cosmetic fluids such, by way of example and not limitation, as nail polish and enamels, lip liner, eye liner and shadow, mascara, and lip gloss and cream. In a particularly preferred form of the invention, the housing 12—or at least that portion peripherally bounding fluid reservoir 18—is constructed of a transparent material so as to enable ready viewing of the color and remaining quantity of fluid stored in the internal reservoir. To protect and conceal certain partially-exposed operating elements of that form of the dispenser 10 herein disclosed, and further to enhance the unit's aesthetic and design appearance, an overcap 20 fabricated by way of example of a metallic or metal-coated material may be disposed over the distal end 14 of housing 12, and an outer shell 22 may similarly cover a portion of the housing periphery at its forward or fluid discharge end 16. The distal end 14 of housing 12 may be fabricated unitarily with the main barrel of the housing or as a separate wall-defining member 23 secured to or engaging the housing barrel to fluid-tightly seal the dispenser's distal end 14. In a currently preferred embodiment of dispenser 10, the end wall or member 23 is formed by sealing gasket fluid-tightly closing the distal end of housing 12 in conjunction with overcap 20. An alternate form of the dispenser of the invention (not shown) wherein a separate sealing gasket abuts the internally-disposed face of end wall member 23 is also contemplated.

The dispenser 10 of the invention further includes a vent opening 24 defined continuously through the distally-disposed end wall or gasket 23 of housing 12 and through overcap 20. A fluid discharge opening 26 defined in the forward end 16 of housing 12 includes a tapered valve seat 28 and a fluid feed channel 30 extending forwardly from the valve seat and through which fluid discharged from internal reservoir 18 is communicated to the depending applicator 32. In the particular form of the dispenser 10 herein illustrated and disclosed, applicator 32 comprises a brush such as may be used in applying nail polish or enamel to a user's nails. Brush applicator 32 is formed of a plurality of brush bristles 34 set or secured in a brush head or collar 36 and mounted on the forward end of the dispenser so that a molded or otherwise formed cavity 38 centrally defined within the brush is maintained in fluid communication with fluid feed channel 30. More particularly, brush head 36—which may, by way of example, be fabricated by heat fusing the ends of the bristles into the form of a ring or collar—is held or secured between the forwardmost end 16 of housing 12 and a tapered nose tip 40 which is mounted on and extends beyond the end 16 of the dispenser housing.

As should now and will continue to become further apparent, applicator 32 may take on a variety of forms and configurations in addition to that of a brush or, indeed, to the particular brush construction shown and described herein. Thus, although the particular embodiment of the fluid dispenser of the invention herein disclosed incorporates a specific brush-type applicator 3 well suited for the dispensing and application of nail polish or enamels and the like, alternative applicators of vastly different constructions, more especially suited for applying other fluids operatively dischargeable by the inventive dispenser—such for example as foam tips and mascara combs and the like—may be substituted and employed. Such alternate forms and uses of the dispenser 10 are fully within the scope and contemplation of the invention. Moreover, equally within the scope and contemplation of the invention is an embodiment of a fluid dispenser that does not carry a depending applicator but, rather, is arranged for discharge of stored fluid—such, by way of example and not limitation, as a paint, medicant, glue or other adhesive—directly onto a workpiece or surface.

Fluid dispenser 10 further includes a variable length assembly formed, in the embodiment illustrated in FIGS. 1 through 10, of a first operating member 44 and a second operating member 46. As hereinafter described, the first and second operating members are disposed within the interior of housing 12 in a mutually coupled arrangement for relative movement of the members 44, 46 during user-effected operation of the dispenser 10.

Figure 6:
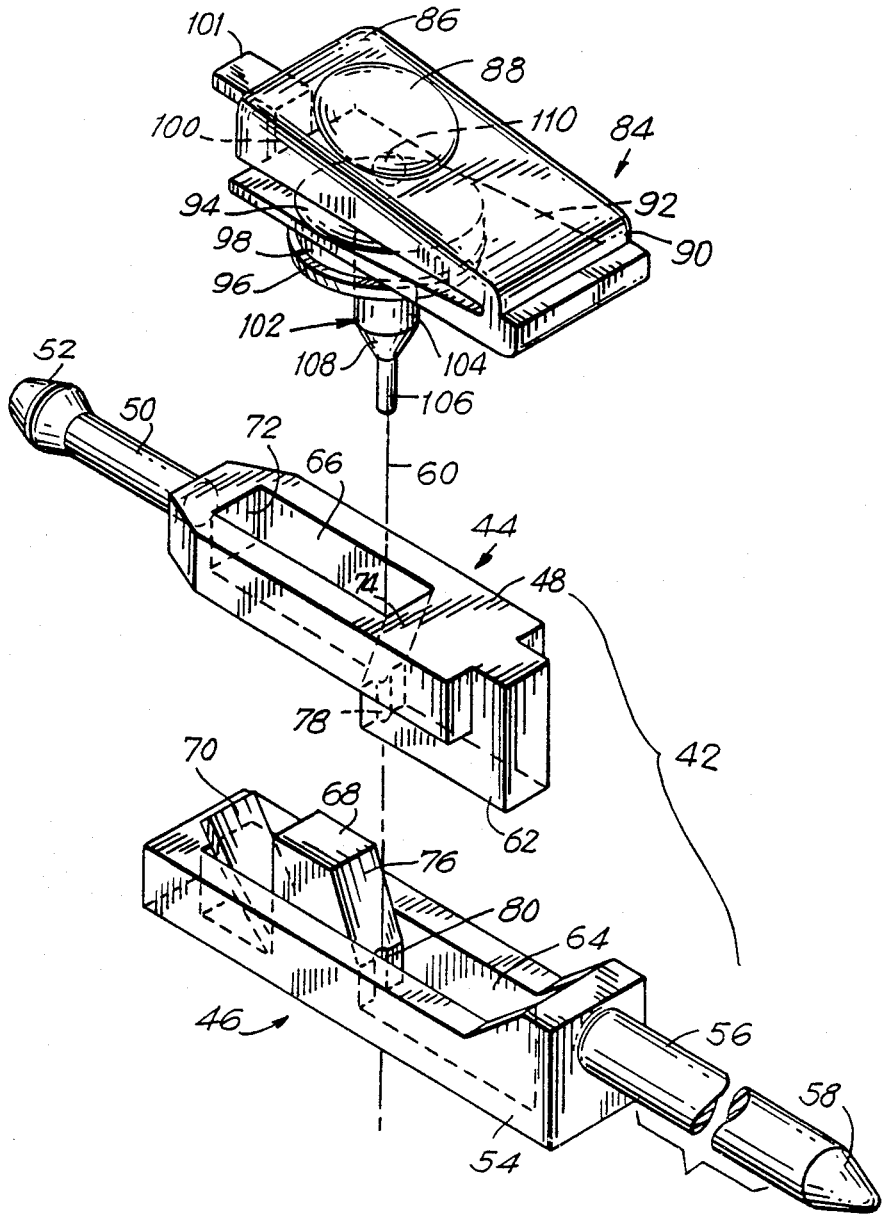
FIG. 6 is an exploded elevated perspective view of the actuating assembly and the variable length assembly of the dispenser.

With particular reference to FIG. 6, first operating member 44 comprises an upper wedge block 48, an elongated valve rod 50 projecting from the forward-disposed end of block 48, and a valve member or stopper 52 carried on the free end of rod 50. Stopper 52 has a front taper configured for fluid-tight sealing engagement with the tapered seat 28 of fluid discharge opening 26. Thus, stopper 52 and seat 28 form a normally-closed fluid discharge valve that is selectively opened to permit the forced discharge of stored fluid from reservoir 18 during user-effected operation of fluid dispenser 10.

Second operating member 46 similarly comprises a lower wedge block 54 and a piston rod 56 projecting from the distally-disposed end of block 54. In a preferred form of the invention, rod 56 has a smooth periphery for reasons that will become apparent as this description proceeds. The free end 58 of rod 56 is tapered for releasable fluid-tight sealing engagement with the vent opening 24 in wall 23 at the distal end 14 of housing 12. As previously indicated, wall 23 may be optionally implemented or supplemented by a sealing gasket so as to enhance the integrity of the fluid-tight seal between tapered rod end 56 and vent opening 24. In a particularly preferred form of the invention, and as hereinafter more fully described in connection with the operative use of the dispenser 10, gasket 23 may additionally have a thickness selected to assist in maintaining rod end 58 in appropriately aligned relation with vent opening 24 for assuring fluid-tight sealing of opening 24 through abutting engagement with rod end 58.

Figure 4:
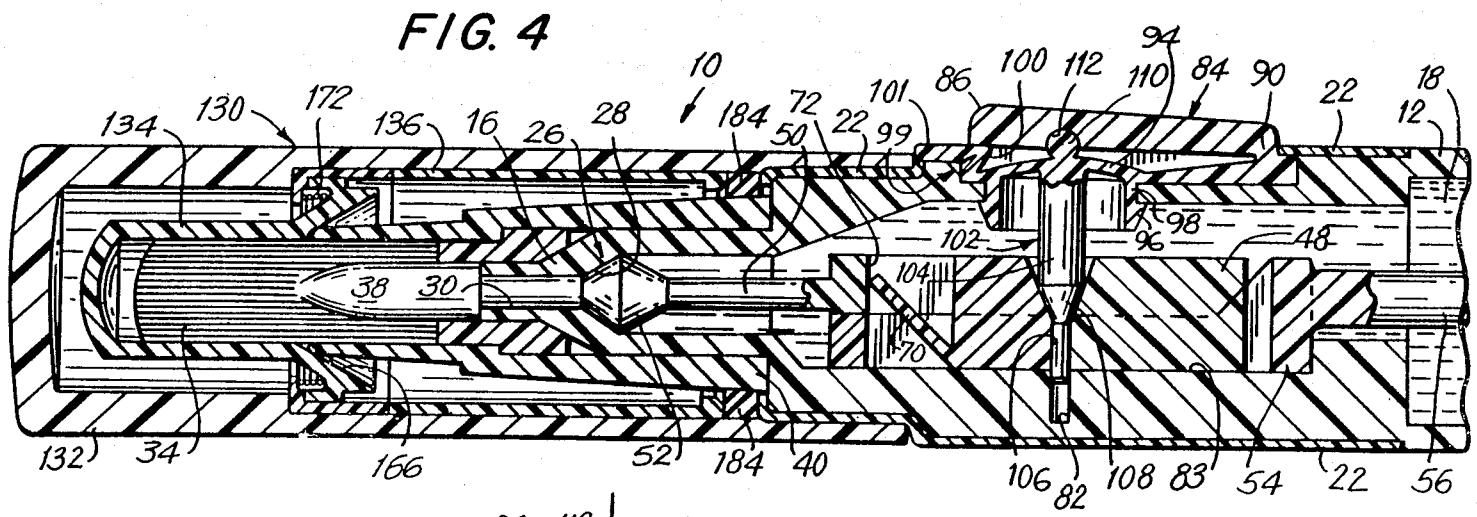
FIG. 4 is an elevated sectional side view of a portion of the dispenser of FIG. 1 in its storage condition and having a closure cap protectively fitted about the fluid discharge end of the dispenser.
Figure 5:
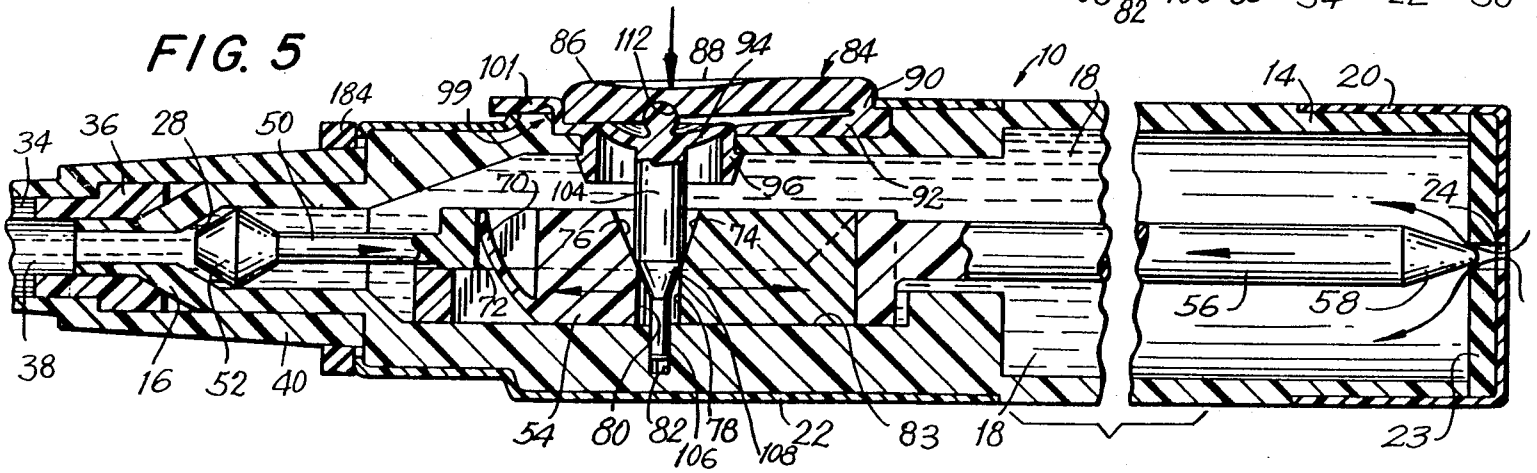
FIG. 5 is an elevated sectional side view similar to FIG. 4 wherein the dispenser is shown following the completion of a fluid-discharging actuation of the dispenser.

Upper and lower wedge blocks 48, 54 are configured for mutually coupled juxtaposition in the manner best seen in FIGS. 4 and 5 and indicated by the vertical dash-dot line 60 in exploded FIG. 6—i.e. such that upper block 48 is received partially within and abuttingly atop lower block 54. For this purpose, upper block 48 includes a downwardly-projecting boss 62 which is receivable within a cutout 64 defined in lower block 54. Upper block 48 further includes a cavity 66 open at both top and bottom for receiving an upwardly-projecting boss 68 and a flexibly-resilient spring or return member 70 of lower block 54. Return spring 70, in the mutually coupled operating positions of upper and lower blocks 48, 54, engages the forwardly-disposed contact surface or wall 72 of upper block cavity 66. Of course, spring 70, and its function in the operation and use of the dispenser 10, can alternatively be implemented by any of numerous other return member structures and parts. For example, in the absence of the illustrated resilient member 70 a compression spring (not shown) might be interposed spanningly between wall 72 and the confrontingly opposed face of boss 68. Such substitutions are fully within the scope and contemplation of the invention.

Each of the upper and lower blocks 48, 54 further includes a sloped operating or wedging surface 74, 76, respectively. In the assembled condition of fluid dispenser 10 wedging surfaces 74, 76 present oppositely-oriented slopes; i.e. the downward slope of surface 7 faces fluid discharge opening 26 and the forward end of housing 16, whereas the downward slope of surface 7 faces vent opening 24 and the distal end 14 of the housing. Semi-circular tubular cutouts 78, 80 in the bosses 62, 68 of upper and lower blocks 48, 54, respectively, extend downwardly from wedge surfaces 74, 76 and, in the coupled condition of blocks 48, 54, together define a tubular passage in concentric communication with a guide bore 82 in housing 12.

In the assembled condition of dispenser 10, lower wedge block 54 is carried partially within an elongated cutout 83 in an interior surface portion of housing 12. From the perspective of the dispenser shown in FIGS. 1, 2 and 3, cutout 83 is located in the face of a shelf 82 which extends radially inward from the periphery of housing 12, and lower wedge block 54 rests partially set into the cutout. To allow block 54 to longitudinally reciprocate as the dispenser 10 is operated to discharge stored fluid onto applicator 32, cutout 83 is dimensioned such that its the longitudinal extension is greater than that of the base of lower block 54, thus permitting block 54 to longitudinally slide within and along the cutout. Cutout 83 thereby forms a sliding raceway for the operative reciprocating movement of block 54.

A user-selected quantity of fluid stored in internal reservoir 18 is mechanically discharged from dispenser 10 by manual operation of an actuator assembly identified by the general reference numeral 84 and best seen in the elevated perspective of FIG. 6. In a particularly preferred form of the invention, assembly 84 is of unitary construction, although it is also contemplated that the actuator assembly be formed of several separately-fabricated, interlocking or otherwise interengaging parts. In any event, actuator assembly 84 includes a button 86, optionally further provided with a structurally-differentiated finger contact area or zone 88 such, for example, as the shallow substantially concave depression shown in FIG. 6, and is resiliently hinged at 90 for pivotal movement with respect to base 92. Substantially centrally disclosed along the extension of base 92 is a resilient dome 94 which defines a flexible diaphragm. In an alternate form (not shown) of the actuator assembly of the invention, dome 94 is omitted and base 92 is dimensioned for resilient flexibility; many other alternate structures performing this function may also be utilized in accordance with the invention. Base 92 is secured to housing 12 by means of a continuous annular or segmented tab 96 which snap fits of otherwise engages an internal peripheral surface of housing 12. Tab 96 is carried on the free end of a skirt 98 that projects downwardly from base 92. A locking member, implemented in the disclosed fluid dispenser 10 in the form of a resilient Z-spring 99, depends from the forward end of the actuator assembly base 92 opposite hinge 90. In the preferred and illustrated construction of the invention, Z-spring 99 is integrally fabricated with base 92 and includes an arm 100 connected at one end to base 92 and at its opposite end to a tab 101 which extends along a portion of the outer periphery of housing 12.

Actuator assembly 84 further comprises an elongated and generally tubular actuator or plunger 102 having a main body portion 104 which depends or extends downward from the bottom face of diaphragm 94, a reduced diameter guide pin 106, and a frustoconical tapered portion 108 connecting body portion 104 and guide pin 106. As shown in FIGS. 4 and 5, guide pin 106 is cross-sectionally dimensioned for guided longitudinal reciprocation within the passages defined by semi-circular tubular cutouts 78, 80 and by guide bore 82. An optional knob or key 110 substantially centrally disposed on the top face of diaphragm 94 snap fits or is otherwise received in a conforming notch 112 defined in the underside of actuator button 86, preferably in the manner of a ball joint assembly, for assisting the return of plunger 104 from its FIG. 5 to its FIG. 4 position after each fluid discharging operation of the dispenser 10.

Defining the distal end of internal fluid reservoir 18 is a piston 114 which is operatively carried on and for unidirectional longitudinal movement along piston rod 56. With particular reference to FIGS. 10 and 11, piston 114 comprises a generally frustoconical body 116 having a central throughbore 118 through which piston rod 56 is journalled; throughbore 118 is accordingly dimensioned to substantially conform to the diameter of rod 56 while permitting relative sliding movement of the piston longitudinally therealong. Of course, although piston rod 56 and throughbore 118 are both of circular cross-sectional shape in the form of the dispenser 10 herein disclosed, numerous other mutually-conforming configurations may alternatively be substituted within the contemplation of the invention. Whatever that configuration, however, it is preferred that piston rod 56 have a substantially smooth periphery.

Piston body 116 tapers to its minimum diameter toward the forward or fluid discharge end of dispenser 10 and, at its forwardmost, minimum diameter end 120, is dimensioned to provide a fluid-tight seal and thereby prevent the passage of stored fluid between tip 120 and the outer periphery of rod 56 as piston 114 operatively moves in the direction of arrow 122 during fluid-discharging use of the dispenser 10. This fluid-tight seal may for example be implemented by unitarily fabricating the piston of a relatively soft plastic material and appropriately dimensioning throughbore 118 at tip 120 to closely conform to the diameter of rod 56, or (as illustrated in the drawings) by molding or otherwise securing a soft plastic wiper gasket to piston body 116 at its forward tip 120, or in any other suitable manner.

Radially-outwardly extending from piston body 116 is an annular extension arm 123 that carries a forward-pointing annular wing 124 and a rearwardly-oriented annular wiper blade 126. The combined and juxtaposed surfaces of the frustoconical outer periphery of piston body 116, extension arm 123 and wing 124 define an annular notch 127 for facilitating the discharge of stored fluid from the interior of dispenser 10. As best seen in FIG. 10, the forward-pointing end of wing 124 is maintained in spaced apart, preferably closely spaced apart, relation to the interior periphery of housing 12, as for example at a clearance of from about 0.001 to 0.002 inches between the wing tip and the radially-adjacent housing wall. The distal tip of wiper blade 126, on the other hand, is maintained in a frictional, interference fit with the interior periphery of housing 12 so as to form a fluid-tight seal between blade 126 and the interior periphery of housing 12.

The rear face of piston body 116 carries an anti-reverse grabber 128 disposed about piston rod 56 for ratcheting or grabbing engagement with the piston rod. Grabber 128, which may be appropriately secured to piston body 116 and includes a substantially centrally-located hole through which piston rod 56 extends, has a rearward or distally-oriented slope so that it engages rod 56 at a nonperpendicular orientation thereto. Briefly stated, the rearward or distally-angled engagement of grabber 128 with the periphery of piston rod 56 permits the grabber (and the piston 11 to which it is secured) to frictionally slide along rod 56 in the direction of integral lower wedge block 54 but prevents relative sliding movement of grabber 128 and piston 114 in the opposite direction—i.e. toward the free or tapered end 58 of rod 56. Put another way, leftward (in FIGS. 1, 4 and 5) axial movement of piston rod 56 must carry piston 114 through a corresponding leftward displacement which is necessitated by the locking engagement of grabber 128 with the rod periphery, whereas piston 114 is capable of relative sliding motion—for example by remaining in its then current position with respect to dispenser housing 12—as rod 56 moves to the right. In the presently preferred form of the invention herein disclosed, the anti-reversing function of grabber 128 is implemented by constructing the grabber of a metal spring material having a suitably-defined edge forming the periphery of its central opening, and by fabricating piston rod 56 of a relatively soft plastic. Grabber 128 may, by way of example, have the somewhat conical or outwardly curved form illustrated in FIG. 11. By this arrangement, the angularly disposed grabber edge or rod-engaging edge portions, although frictionally slidable to the left along the smooth periphery of rod 56 by reason of the angle formed between the grabber and rod, actually cuts into and thereby locks or ratchets with the soft plastic material of the piston rod when piston motion to the right along rod 56 (or displacement of rod 56 to the left) is attempted. Those skilled in the art will nevertheless appreciate that numerous alternate arrangements for implementing the intended unidirectional movability of piston 114 along rod 56 may be employed in a dispenser constructed in accordance with the present invention.

Figures 7, 8, 9:
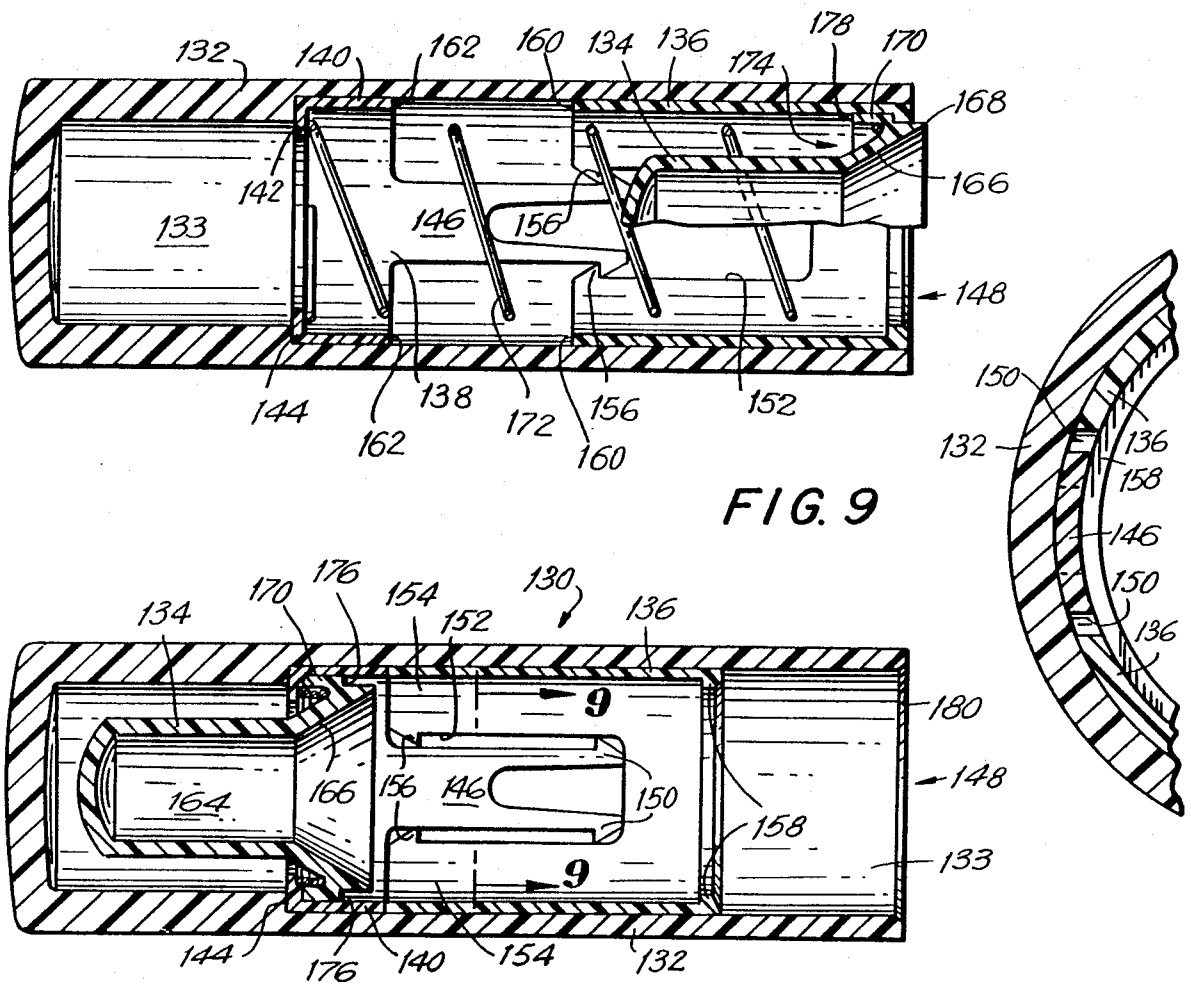
FIG. 7 is an elevated sectional view, partially broken away, of a closure cap constructed in accordance with the invention for use with a fluid dispenser and showing the relative positions of its component parts when the cap is disposed separate and apart from the dispenser.
FIG. 8 is an elevated sectional view, partially broken away, of the closure cap of FIG. 7 showing the relative positions of its component parts when the cap is protectively disposed about the fluid-discharge end of the dispenser.
FIG. 9 is a cross-sectional view, partially broken away, taken along the lines 9—9 in FIG. 8.

A closure cap 130, for releasable engagement over the fluid-discharge and applicator-carrying end of dispenser 10 during periods of nonuse of the dispenser, is illustrated in FIGS. 7 through 9. The construction of cap 130 includes a generally cylindrical cap body or shell 132 having a central opening 133, an applicator shuttle 134, an intermediate shuttle 136 and a positionally fixed member 138. Shuttles 134 and 136 are each disposed for captured longitudinal movement within shell 132.

An annular base portion of fixed member 138 comprised of a peripheral wall 140 and a radially-inwardly projecting spring perch extension 142 is set into a radial step 144 of the interior periphery of shell 132. A pair of extension arms 146 which depend from the base of member 138 and extend toward the open end 148 of cap 130 along diametrically opposed portions of the interior face of the cap shell wall. Each arm 146 terminates at its free end in a substantially U-shaped construction incorporating a pair of retaining tabs or fingers 150.

Intermediate shuttle 136 consists of an annular sleeve slidably moveable along the interior periphery of cap shell 132 and having a pair of diametrically-opposed, substantially U-shaped cutouts 152 located and dimensioned for receiving fixed member extension arms 146 therewithin. The legs 154 of each U-shaped cutout 152 carry retaining tabs or fingers 156 which, as hereinafter described, are engageable with the tabs 150 of fixed member 138 to capture intermediate shuttle 136 within cap 130 The end of intermediate shuttle 136 nearest the open end 148 of cap 130 includes a radially-inwardly extending rim 158, and the opposite end 160 of shuttle 136 is configured for abutment with a stop face 162 on the peripheral wall 140 of fixed member 138 for limiting inward movement of shuttle 136 along cap shell 132.

Applicator shuttle 134 is comprised of a head 164 configured and dimensioned for receiving applicator 132 therewithin and having an open end bounded by a radially-outwardly flared annular wall 166 which terminates in proximal edge 168. In the form of dispenser 10 illustrated in the drawing wherein applicator 132 is an elongated brush, head 164 is of generally conical construction although it may instead assume almost any shape appropriate or desired for the particular fluid applicator borne by a dispenser in accordance with the invention. Flared wall 166 carries a radially-outwardly disposed foot 170 for relative sliding abutment against the inner periphery of intermediate shuttle 136. In the assembled condition of cap 130, a coiled compression spring 172 provided between fixed spring perch 142 and notch 174 defined between foot 170 and flared wall 166 normally urges applicator shuttle 134 toward the open end 148 of the cap. A shoulder 176 on the proximal end of foot 170 is engageable with the rim 158 on intermediate shuttle 136 for limiting travel of the applicator shuttle 134 toward the cap open end 148 under the urgency of spring 172 to render shuttle 134 captive within cap shell 132. Maximum inward travel of applicator shuttle 134 is similarly limited by abutment of a stop edge 178 on foot 170 with fixed spring perch 142. It should particularly be noted that in a preferred form of the invention, and as shown in FIG. 7, the limit of outward travel of applicator shuttle 134 places its proximal edge 168 beyond the lip 180 at the open end 148 of cap 130—i.e. beyond the end edges of cap shell 132 and intermediate shuttle 136. This arrangement enables the realization of especially advantageous operating benefits in the use of the cap 130, as hereinafter described.

Operative use of the fluid dispenser 10 of the invention will now be described with particular reference to FIGS. 1, 4 and 5. FIGS. 1 and 4 show the dispenser and its various operating elements in their initial positions prior to a fluid-discharging actuation, with FIG. 4 illustrating the storage condition of the dispenser 10 with cap 130 fully seated on its discharge end protectively enclosing applicator 32. As there shown, the abutting engagement of the flexibly resilient return spring 70 of lower block 54 with the contact surface 72 of upper block 48 urges blocks 48, 54 in mutually opposed directions such that, in the unactuated condition of dispenser 10, variable length assembly 42 is maintained in its maximum longitudinal extension. More particularly, the abutment of spring 70 with surface 72 concurrently urges lower block 54 and its integral piston rod 56 toward the rear or distal end of dispenser 10 and upper block 48 and its integral valve rod 50 toward the forward or fluid discharge end of the dispenser. In any event, in the unactuated condition of the dispenser the stopper 52 on valve rod 50 is driven into and maintained in fluid-tight sealing engagement with valve seat 28 to close fluid discharge opening 26 and thereby prevent undesired leakage or loss of stored fluid from internal reservoir 18 through feed channel 30 or onto applicator 32. Tapered end 58 on piston rod 56 is concurrently driven into and maintained in fluid-tight sealing engagement with the periphery of the vent opening 24 in gasket or wall 23 at the distal end of dispenser 10 to thereby fluid-tightly seal the distal end of the dispenser.

To initiate a discharge of stored fluid from within dispenser 10 with cap 130 unseated and separated therefrom, the user manually depresses actuator assembly button 86 by which the button inwardly pivots at hinge 90 and drives resilient diaphragm 94 and plunger 102 correspondingly downward into the interior of housing 12. As plunger 102 is axially driven from its first (FIG. 4) to or toward its second (FIG. 5) position, its tapered peripheral portion 108 slides along the oppositely-sloped operating surfaces 74, 76 of upper and lower blocks 48, 54, thereby wedging the sloped operating surfaces into increasingly spaced apart relation and forcing blocks 48, 54 to longitudinally slide or move in opposite directions against the urgency of return spring 70. More particularly, as plunger 102 moves from its first to its second position the upper block 48 and its integral valve rod 50 are driven toward the distal end of dispenser 10 whereby stopper 52 is retracted from sealing engagement with seat 28, and lower block 54 and its integral piston rod 56 are concurrently and correspondingly driven toward the fluid discharge end of the dispenser whereby tapered rod end 58 is retracted from sealing engagement with vent opening 24. In effect, actuating depression of button 86 causes a longitudinal foreshortening of variable length assembly 42 as valve rod 50 and piston rod 56 are concurrently retracted toward the coupled wedging blocks 48, 54. Fluid discharge opening 26 and vent opening 24 are thereby concurrently unsealed and opened by inwardly-driven movement of plunger 102 as button 86 is manually and operatively depressed by a user. Guide bore 82, which receives the axially advancing guide pin 106 of plunger 102 as the plunger is driven from its first to its second position, guidingly assures unskewed, straight-line travel by plunger 102 so that the conversion of its actuator button driven, substantially radially-aligned motion to the longitudinally-oriented movement of the first and second operating members 44, 46 along housing 12 is substantially equally distributed between the upper and lower blocks 54, 48 for concurrent opening—and subsequent resealing—of fluid discharge and vent openings 26, 24.

In a particularly preferred form of the inventive dispenser 10, end wall or gasket 23 has a thickness selected so that, as tapered rod end 58 is retracted from fluid-tight sealing engagement with the periphery of vent opening 24 by actuator-driven sliding movement of lower block 54, at least a portion of tapered rod end 58 remains radially within the peripheral wall which defines vent opening 24 in gasket 23—even in the fully and maximally retracted position of piston rod 56 and its tapered end 58. Put another way, although retraction of piston rod 56 carries its tapered end 58 out of abutment with the peripheral wall which bounds and defines vent opening 24 in gasket 23, thereby breaking the normal fluid-tight closure of opening 24, rod end 58 is never retracted completely clear or out of the opening 24 by reason of the predeterminately selected thickness of the preferred gasket 23. As a consequence of this arrangement the periphery of vent opening 24 in gasket 23 may assist in guiding rod end 58 into fluid-tight sealing engagement with opening 24 following each fluid-discharging actuation of dispenser 10, thereby assuring continued alignment of rod end 58 with vent opening 24 and the resulting fluid-tight closure of opening 24 in the unactuated condition of the dispenser.

As lower wedge block 46 and its integral piston rod 56 are driven toward the discharge end of dispenser 10—i.e. to the left in FIGS. 1 and 4—rod 56 carries piston 114 through a corresponding leftward displacement. It will be recalled that grabber 128 cooperatively engages rod 56 in such a way as to permit relative sliding movement of piston 114 leftward (toward lower block 46) along rod 56 but preventing relative piston movement to the right (toward the tapered end 58 of rod 56) therealong. Consequently, as block 46 and rod 56 are operatively driven to the left by user depression of actuator button 86, the ratcheted engagement of grabber 128 with rod 56 forces piston 114 to be carried with the rod and, therefore, leftward within and along housing 12. Since piston 114 defines the distal end of internal fluid reservoir 18, this leftward displacement of the piston effects a longitudinal foreshortening and volumetric contraction or reduction of the internal fluid storage reservoir 18. As hereinafter described, this volumetric decrease or contraction of reservoir 18 causes stored fluid to be discharged from the dispenser interior through discharge opening 26. The concurrent unsealing of vent opening 24 by retraction of piston rod end 58 prevents the undesired development of a vacuum within housing 12 by allowing entry of ambient air through opening 24 into that part of housing 12 located distally (i.e. to the right) of piston 114. The air entering housing 12 through vent opening 24 thus volumetrically replaces the stored fluid discharged from dispenser 10 in each user-effected manual actuation of the dispenser.

The volumetric contraction of fluid reservoir 18 caused by the leftward displacement of piston 114 forces the discharge of a quantity of stored fluid through discharge opening 26. It should further be pointed out that the radially-inward movement of actuator diaphragm 94 as button 86 is depressed also effects a small volumetric reduction of the fluid reservoir and thus further pressurizes the stored fluid to facilitate its discharge through opening 26. Opening 26, of course, is opened by the retraction of valve rod 50 which occurs concurrently with the piston-displacing retraction of piston rod 50 as actuator button 86 is manually depressed. Thus, the increased pressure created within reservoir 18 as its volume is reduced by the combination of leftward displacement of piston 114 and inward movement of diaphragm 94 is substantially simultaneously relieved by the concurrent unsealing of discharge opening 26 through which stored fluid is discharged into feed channel 30 and then onto applicator brush 34 through its internally-defined cavity 38.

As should be apparent, the quantity of fluid discharged onto applicator 32 during a user-depressing actuation of button 86 is proportionally related to the volumetric reduction of reservoir 18 caused by leftward movement of piston 114. Since the volumetric reduction of the fluid storage reservoir is determined by the lineal leftward displacement of piston 114, which is determined by the leftward displacement of piston rod 56 and of integral lower wedge block 54, which is in turn determined by the radially-inward axial movement of plunger 102 as driven by button 86, it is the distance by which the user depresses actuator button 86 that directly controls the volume or quantity of stored fluid operatively discharged onto applicator 32. Accordingly, in the preferred form of the fluid dispenser 10 of the invention the user may selectively control the amount of fluid discharged from the internal storage reservoir by depressing actuator button 86 through a selected radially-inwardly directed displacement. The further the user depresses button 86, the greater the axial displacement of plunger 102, the greater the longitudinal foreshortening of variable length assembly 42, the greater the retraction of stopper 52 from valve seat 28 and of tapered rod end 58 from vent opening 24, the greater the leftward displacement of piston 114, the greater the volumetric reduction of fluid reservoir 18, and the more fluid discharged from reservoir 18 through fluid discharge opening 26.

In the currently preferred form of the invention, piston 114 is specially configured both to operatively facilitate the discharge of stored fluid and to enhance the aesthetic appearance of the dispenser 10. During reservoir volume-reducing leftward displacement of piston 114 the combination of the frustoconical taper of piston body 116, the forwardly-extending annular wing 124 and the notch 127 formed therebetween define a scoop-like structure which facilitates the leftward movement of stored fluid toward the forward end of dispenser 10 and discharge opening 26. In addition, the closely spaced apart juxtaposition of the tip of wing 124 with the interior periphery of housing 12 permits a small amount of stored fluid to flow between the wing tip and the housing wall and thus enter the annular space 182 bounded by wing 124, wiper blade 126 and the housing wall. This substantially and effectively limits, and greatly enhances the effectiveness of, the wiping action required of the tip of annular blade 126 which frictionally engages the housing periphery to form a fluid-tight seal therewith for preventing the passage or escape of fluid distally beyond the blade tip. Moreover, this arrangement permits the realization of a wide variety of advantageous aesthetic effects.

For example, it is desireable to enable the user of a fluid dispenser 10 adapted, by way of example, for the selective discharge of nail enamel to view the internal fluid reservoir for ascertaining the color and remaining quantity of nail enamel therein contained. For this purpose, housing 12 may be fabricated of a transparent material, with operating portions of the dispenser concealed as by providing a metallic outer shell 22 and a metallic overcap 20 at appropriate locations along the housing. By employing the disclosed piston 114 of the invention, the piston is self-concealing and thus substantially invisible to a user of the dispenser 10. That is, the closely spaced apart juxtaposition of annular wing 124 by which a small amount of the internally-stored nail enamel is received in the annular space 182 conceals that portion of piston 114 that is closest to and therefore otherwise most readily visible through the transparent housing wall by a user of the dispenser 10. The user sees only the tip of wiper blade 126 distally beyond which the nail enamel is unable to pass and which, in any event, preferably extends distally beyond the remainder of piston 114. The fluid-tight forward tip seal 12 between piston body 116 and the rod 56 similarly prevents the escape of nail enamel from within reservoir 18 distally along rod 56 beyond the piston. Consequently, as the dispenser 10 is repeatedly used and more and more fluid is discharged from its internal reservoir 118, the interior of the housing 12 distally of the advancing piston 114 remains substantially clean of nail enamel or other fluid stored in the reservoir and the stored fluid is visible only within the reduced volume of the internal reservoir.

Upon release of the depressed actuator button 86 following a user-initiated, fluid dispensing operation of the dispenser 10, the various operating assemblies and parts of the dispenser automatically return to their initial, FIG. 4 positions. When the user releases the radially-inwardly depressed button 86, the button is pivotally driven radially outward by the resilient hinge 90. Plunger 104 moves correspondingly upward to its original position, carried with button 86 by the coupled engagement of knob 110 with notch 112 in the underside of the button. The plunger 104 may also be assisted or, instead, solely driven in its return movement by one or more other arrangements. Thus, the resilient or assisted return of diaphragm 94 to its FIG. 4 position, and the relative return displacements of upper and lower wedge blocks 48, 54 under the urgency of spring member 70, may be employed in this regard. It is also contemplated that a coiled compression spring (not shown) may be provided about plunger guide pin 106, disposed for example within guide bore 82, for carrying out or assisting the return of plunger 10 to its initial position.

The upward retraction of plunger 102, or its substantially unimpeded ability to be so driven following completion of a fluid discharging operation of the dispenser, enables the normal urgency of resilient return spring 70 against surface 72 to concurrently drive upper block 48 toward the discharge end of the dispenser whereby stopper 52 recloses valve seat 28, and lower block 54 toward the distal end of dispenser 10 such that tapered rod end 58 recloses vent opening 24. These actions reseal the dispenser for fluid-tightly preventing unintended further discharge of stored fluid.

As lower wedge block 54 and its integral piston rod 56 are driven and returned toward the rear or distal end of the dispenser, piston 114 maintains its longitudinal position along housing 12 and slides relatively along and with respect to the axially moving rod 56. That piston 114 remains substantially fixed relative to housing 12 as rod 56 moves is primarily a consequence of the frictional interference fit between the piston's annular wiper blade 126 and the interior peripheral wall of the housing. In this manner, the size of reservoir 18 is maintained at all times in substantial conformity to the volume of stored fluid that remains therewithin, and substantially normal or ambient pressure is maintained within the housing interior on the distal side of piston 114.

During periods of storage or nonuse, the dispenser 10 may be protectively fitted with a cap such as the cap 130 herein disclosed and constructed in accordance with the present invention. As shown in FIG. 4, cap 130 is releasably engageable over the fluid dispensing end of the dispenser for fully enclosing applicator 32 and the dispenser's tapered nose tip 40.

As previously described, cap 130 includes two relatively movable shuttles 134, 136 which are normally—i.e. during periods of nonuse of the cap—maintained by the urgency of compression spring 172 with their dispenser-engaging ends proximate the open end 148 of the cap as shown in FIG. 7. As the cap 130 is relatively moved toward the fluid discharge end of dispenser 10 for engagement therewith, initial contact between the cap and dispenser is achieved as brush bristles 34 are received within the head 164 of applicator shuttle 134, thus facilitating user alignment of the cap and dispenser. As applicator 32 slides into shuttle head 164 toward its predetermined maximum penetration therewithin, the forward end of dispenser nose tip 40 next abuttingly engages the outwardly flared wall 166 of shuttle 134 and, with continued advancement of cap 130 onto dispenser 10, drives shuttle 134 leftward (in FIG. 7) into the cap interior against the urgency of spring 172. With further continued advancement of cap 130 onto dispenser 10, the rim 158 of intermediate shuttle 136 abuts against a sealing gasket 184 on the exterior dispenser periphery and is thereafter driven leftward into the cap interior. The function and location of gasket 184 may alternatively be implemented by many other constructions such, for example, by unitarily incorporating it as an integral part of nose tip 40.

In a preferred implementation of the cap and dispenser, the abutting engagement of the forward end of nose tip 40 with the outwardly-flared wall 166 of applicator shuttle 134 effects a substantially fluid-tight seal therebetween. The integrity of that seal may be further enhanced by appropriately configuring the nose tip 40 and/or wall 166 with any modified or additional structure satisfactory for that purpose. This fluid-tight seal, as hereinafter described, minimizes the volumetric atmosphere present about the applicator when protectively enclosed within the head 164 of applicator shuttle 134 and thereby effectively prevents, or at least minimizes and impedes, undesired drying of fluid on the applicator between uses of the dispenser 10.

Leftward movement of applicator shuttle 134 into the interior of cap shell 132 is limited by abutment of shuttle stop edge 178 with the fixed spring perch extension 142. Leftward movement of the intermediate shuttle 136 into the cap interior is similarly limited by abutment of intermediate shuttle end face 160 with the stop face 162 of fixed member peripheral wall 140. In a preferred form of the invention, the applicator and intermediate shuttles 134, 136 reach these limits concurrently as cap 130 becomes fully seated on dispenser 10 as depicted in FIG. 4. Releasable retention of cap 130 o the fluid discharge end of dispenser 10 may be implemented in any appropriate manner such, for example, by providing the cap and dispenser with cooperating snap-fit ridges and grooves or with mutually engaging threads for rotated securement therebetween. The particular arrangement employed for implementing such retention is considered to be a matter of design choice and no specific structure is accordingly depicted.

In a particularly advantageous feature of the invention, when cap 103 is fully seated on dispenser 10 actuator assembly 84 is prevented from movably initiating a fluid discharge operation. As best seen in FIG. 4, the edge of the open end 148 of cap shell 132 is located and configured for engagement with the locking tab 10 of actuator Z-spring 99 prior to full seating of the cap on dispenser 10. As full seating of the cap is then achieved, the edge of the cap shell drives tab 101 rightward against the resilient return urgency of Z-spring arm 100 into underlying abutment with actuator button 86. Downward or radially-inward movement of button 86 is thereby prevented when cap 130 is fully seated on dispenser 10 because Z-spring arm 100 and tab 101 are interposed between the lower face of button 86 and a shoulder on housing 12 or other fixed member. The possibility of discharge of stored fluid through either accidental or intentional actuation of assembly 84 and of associated operating elements of the dispenser 10 is thus substantially eliminated through this arrangement of cooperating elements on the cap and dispenser. As should be apparent, locking tab 101 automatically returns to its normal operating position—such for example as seen in FIG. 5—in noninterfering relation with actuator button 8 under the resilient urgency of Z-spring arm 100 as cap 103 is removed from fully seated protective engagement about the fluid discharge end of dispenser 10.

As cap 130 is retracted (i.e. moved to the left in FIG. 4) from its fully seated position on the applicator-carrying end of dispenser 10, the return urgency of coil spring 172 causes the outwardly-flared wall 166 of shuttle 134 to be maintained in continued abutment with the end of dispenser nose tip 40. That is, as the nose tip is relatively retracted from within cap 130, spring 172 drives applicator shuttle 134 toward the cap open end 148 and continuously against the retracting nose tip. Applicator bristles 34 thus continue to be protectively enclosed by the shuttle head 164 during removal, as well as during seating as previously described, of cap 130. As the applicator shuttle continues to move rightward toward the cap's open end 148 under the urgency of spring 172, shuttle foot 170 meets and abuts rim 158 of intermediate shuttle 136 and, with continued rightward movement of applicator shuttle 134, drives the intermediate shuttle back to its initial position shown in FIG. 7. Only when both the applicator shuttle 134 and the intermediate shuttle 136 have reached their initial or starting positions proximate the open end 148 of cap 130 does continued relative retraction of the cap from the dispenser cause the applicator brush bristles 34 to be withdrawn from within shuttle head 164.

The construction of the cap 130 herein disclosed provides, when used in conjunction with a cooperatively constructed fluid dispenser, a number of important advantages. Cap 130 substantially reduces the possibility that discharged fluid remaining on applicator 32 will dry out during periods of storage of the dispenser, a significant problem with heretofore known devices. For this purpose, cap 130 incorporates two separate seals of its interior; first, the abutting engagement of dispenser nose tip 40 with the outwardly-flared wall 166 of shuttle 134 sealingly encloses applicator 32 in a minimum volume space and, second, the engagement of intermediate shuttle rim 158 with gasket 184 prevents leakage of additional ambient air into the cap interior after full seating of the cap on the dispenser so that, even if the seal between nose tip 40 and wall 166 is breached, any resulting drying of the brush is substantially slowed.

The construction of cap 130 further assures that fluid discharged from dispenser 10 onto applicator 32 remains within the confines of applicator shuttle 134 and will not travel or leak or be transferred to other interior portions of the cap. As previously pointed out, the proximal edge 168 of applicator shuttle 134 extends outwardly beyond the cap shell lip 180 when the cap is disposed uncoupled and separate from the body of dispenser 10. This outward overextension of edge 168, and the outward flaring of the annular wall 166 from which it depends, both facilitate user alignment of the brush bristles as the cap is advanced into protective placement over the applicator and the discharge end of the dispenser, and shield the diametrically-outward portions of the shuttles 134, 136 and of the cap shell 132 from inadvertent contact with brush-carried fluid as the applicator is inserted into the applicator shuttle. Moreover, the fluid seal effected between the dispenser nose tip 40 and the flared wall 166 of shuttle 134 further prevents outward leakage of brush-carried fluid from the interior of the shuttle head 164. This construction of cap 130 thus assures that all discharged fluid entering the cap interior remains within the confines of applicator shuttle 134 and that the remainder of the cap interior stays clean of fluid. As a consequence, cap shell 132 and applicator shuttle 134 may be fabricated of a transparent material to enable a user to view, for example, the applicator type (or other aspects thereof) prior to sale or use, as well as the color and/or other characteristics of any discharged fluid thereon after use, while presenting an aesthetically appealing and highly commercial appearance both before sale to the consumer and after multiple fluid discharging uses of the dispenser and cap combination.

There has accordingly been herein disclosed a currently preferred embodiment of a fluid dispenser and associated end closure cap having novel structural and operating features and offering significant functional advantages over fluid dispensers and closure caps heretofore known in the art. It should of course be recognized that numerous constructural details of individual parts, of combinations of elements, and of operating subassemblies of the dispenser and cap are secondary to the inventive aspects and features as herein disclosed and may be implemented in any appropriate and desired manner as a matter of design choice. For example, although preferred characteristics of the particular materials from which certain components are fabricated has been mentioned in this disclosure, for the most part the construction material selected for any given part of the dispenser or closure cap in practicing the invention is unimportant and immaterial. It is, on the other hand, an obvious requirement that all components or surfaces that operatively contact the particular fluid stored in and discharged from the dispenser 10 must be fabricated of a material impervious to and nonreactive with the normal effects of the fluid.

Various elements and operating assemblies of the fluid dispenser and cap of the invention are also susceptible to modification within the scope and contemplation of the present invention. For example, FIGS. 12 and 13 illustrate a second, alternate form, and FIGS. 14 and 15 show a third, alternate form, of a variable length assembly constructed in accordance with the invention and which may be employed in lieu of the assembly 42 hereinabove described and illustrated in the dispenser embodiment of FIGS. 1 to 9.

Figure 12:
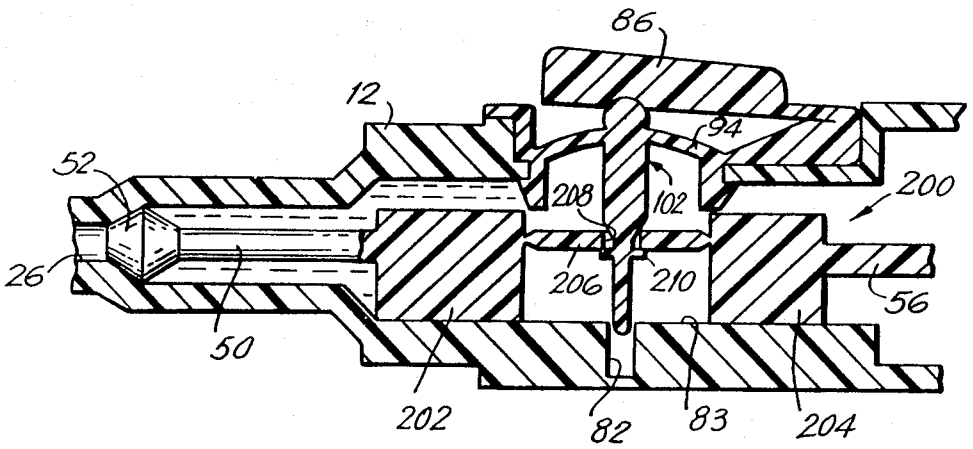
FIG. 12 is an elevated sectional side view, partially broken away, of an alternate form of a variable length assembly in accordance with the invention in its unactuated condition.
Figure 13:
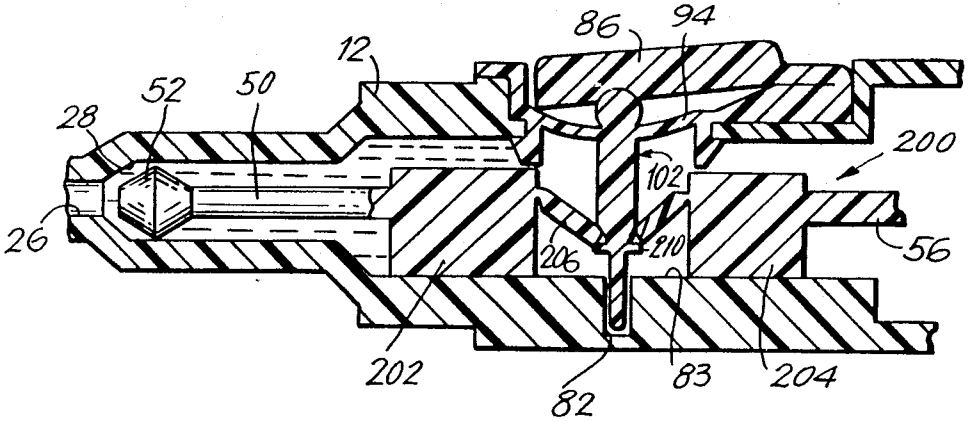
FIG. 13 is an elevated sectional side view, partially broken away, of the variable length assembly of FIG. 12 shown in its actuated condition.

Thus, with reference to FIGS. 12 and 13—wherein like reference numerals are used to identify parts similar to those shown in FIGS. 1 to 9 and various elements unnecessary to an understanding of the instant modification have been omitted—the modified variable length assembly 200 is constructed as a single, integral and preferably unitary assembly which extends longitudinally from a stopper 52 carried on the free end of valve rod 50 for sealing engagement with valve seat 28 to the tapered free end 58 of piston rod 56 which is sealingly engageable with the vent opening 24 (not shown) located at the distal end of the dispenser. Assembly 200 further comprises forward and distal members 202, 204 from which the integral rods 50, 56 projectingly depend, and a flexible web 206 unitarily connecting members 202, 204. Web 206, which is preferably configured for flexible pivotability at its unitary connections to members 202, 204, includes a bore 208 defined in the illustrated embodiment substantially equidistantly between members 202, 204 and through which the guide pin 106 of plunger 102 extends. Plunger 102 is dimensioned, and/or web 206 is located, so that the tapered portion 108 of the plunger abuts the web at bore 208 when the operating components of the dispenser are in their initial, unactuated or pre-use positions (FIG. 12). A retainer clamp or collar 210 or the like may be secured to guide pin 106 immediately below web 206 to facilitate the desired abutment between the tapered portion 10B of the plunger and web 206 continuously before, during and after a user-initiated fluid-discharging actuation of the dispenser.

In use, as actuator button 86 is depressed from its FIG. 12 position to or toward its FIG. 13 position the tapered or otherwise diametrically-widened portion 108 of descending plunger 102 drives the abutting central portion of flexible web 206 downward toward housing shelf 83. Web 206 may be scored or appropriately configured to enable it to deform along a vertical plane extending through bore 208 and substantially equidistant from members 202, 204. The members 202, 204 are arranged for relative sliding movement longitudinally along housing shelf 83 so that, as web 206 is flexibly deformed to a V-like or angled configuration as shown in FIG. 13, members 202, 204 are concurrently drawn relatively together to foreshorten assembly 200 and thereby concurrently retract stopper 52 from seat 28 and piston rod and 58 from vent opening 24. All other elements and parts of the dispenser operate substantially in the manner previously described in connection with the preferred embodiment of the invention shown in FIGS. 1 to 9.

Automatic return of the variable length assembly 200 to its initial FIG. 12 position following completion of a user-effected fluid-discharging actuation of the dispenser may be accomplished through any one or combination of available means. Following the release of the inwardly-depressed button 86, the resilience of hinge 90 and of diaphragm 94 may assist in the upward return of plunger 102, whereby web 206 is pulled upward to its original position by retainer collar 210 on guide pin 106. A coiled compression spring (not shown) may optionally be provided between guide pin 106 and housing shelf 83, or between pin 106 and guide bore 82, for providing or further assisting in the upward, post-discharge return of plunger 102.

Another alternate form of a variable length assembly, this one identified by the general reference numeral 220, is illustrated in FIGS. 14 and 15. As before, like reference numerals indicate parts similar to those shown in connection with the embodiment of FIGS. 1 to 9, and portions of the dispenser not necessary to the following description of the modified assembly 220 are omitted in FIGS. 14 and 15.

In this second alternate form, variable length assembly 220 once more includes the usual forwardly-extending valve rod 50 carrying valve stopper 52, and distally-extending piston rod 56 having a tapered end 58 for sealing engagement with vent opening 24. Rods 50, 56 are connected, at their respective confronting ends remote from stopper 52 and tapered end 58, by a flexible web 222 attached to the rods by flexible connections permitting relative pivotal movement between the rods and web ends. Web 222 may comprise a relatively thin-width portion of material unitarily fabricated with rods 50, 56 and scored or otherwise configured at its connections to the rods for providing the desired flexible pivotability. Alternatively, the web may be formed of the same material as rods 50, 56, or of any other appropriately flexible or deformable material such, for example, as a metal leaf spring, and then molded or linked or otherwise coupled to the confronting ends of the rods. Web 222 has a bore 224 define substantially centrally between the ends of rods 50, 56 to which the web is coupled for receiving the guide pin 106 of plunger 102 in the manner previously described in connection with the embodiment of FIGS. 12 and 13.

Valve and piston rods 50, 56 are supported for longitudinal straight-line reciprocation by the respective bosses 224, 226 which fixedly depend from housing shelf 83. Each boss 224, 226 is provided with an aperture through which the respective rod 50, 56 is journalled; the apertures are dimensioned to enable unimpeded longitudinal sliding movement of the rods axially therethrough. A coiled compression spring 228 is disposed about plunger guide pin 106 and at least partly within housing shelf guide bore 82 for facilitating return of plunger 102 to its initial position following a fluid-discharging operation of the dispenser.

Operation of the modified variable length assembly 220 is similar to that herein described in connection with the first alternate assembly 200. As plunger 102 is driven downward by the manual depression of actuator button 86, tapered portion 108 drives the central portion of flexible web 222 correspondingly downward, causing the web to deform and foreshorten the straight-line distance between its ends. As the ends of the web are thereby drawn toward each other, the rods 50, 56 which are attached or coupled to the web ends are mutually pulled into decreasingly spaced apart relation, effecting a foreshortening of the variable length assembly 220 and concurrently retracting stopper 52 and piston rod end 58 from sealing engagement with valve seat 28 and vent opening 24.

Where web 222 is formed of a resilient material such as spring steel or the like, the subsequent return of plunger 102 to its original position under the urgency of spring 228 after each fluid-discharging actuation of the dispenser permits the web to return, on its own, to its initial, FIG. 14 position. Other means may be employed for assuring the return of a non-resilient web 222 such, for example, as the provision of a collar or clamp (not shown) disposed on or about the plunger guide pin 106 immediately below the web as illustrated in FIGS. 12 and 13. Other elements and parts of a fluid dispenser incorporating the modified variable length assembly 220 operate substantially in the manner previously described in connection with the preferred embodiment of the invention disclosed in FIGS. 1 to 9.

While there have been shown and described and pointed out fundamental novel features of the invention as applied to preferred embodiments thereof, it will be understood that various omissions and substitutions and changes—some of which have been mentioned hereinabove and others that will be apparent from this disclosure—in the form and details of the device illustrated and in its operation may be made by those skilled in the art without departing from the spirit of the invention. It is the intention, therefore, to be limited only as indicated by the scope of the claims appended hereto.

What is claimed is:

1. In a fluid dispenser for manually-effected operator-controlled discharge of a stored fluid:

an elongated dispenser housing defining an interior space for storing fluid dischargeable from the housing, said housing including a fluid discharge opening and a vent opening proximate opposite ends of the housing;

variable length means normally urged to a maximum longitudinal extension between and for concurrently closing said fluid discharge and vent openings; and fluid discharge actuating means operatively movable between a first and a second position for causing foreshortening of said variable length means relative to said maximum longitudinal extension to space said variable length means from and concurrently open said fluid discharge and vent openings whereby stored fluid is discharged from said dispenser through said fluid discharge opening and air enters the housing through said vent opening.

2. In a fluid dispenser in accordance with claim 1, piston means bounding an end of fluid storage interior space remote from said discharge opening and movable along said housing in a direction away from said vent opening and toward said discharge opening as fluid is discharged from said dispenser for decreasing the volume of said fluid storage interior space by an amount substantially corresponding to fluid discharged from the dispenser.

3. In a fluid dispenser in accordance with claim 2, wherein said variable length means comprises a first part normally urged into closing relation with said fluid discharge opening and a second part normally urged into closing relation with said vent opening, said movement of the actuating means from said first to said second position effecting movement of said first and second parts of said variable length means out of closing relation with the discharge and vent openings, respectively, by foreshortening of said variable length means from said maximum longitudinal extension.

4. In a fluid dispenser in accordance with claim 3, wherein said piston means is associated with said second part of the variable length means for movement along said housing with said second part only as said second part moves out of closing relation with said vent opening, said movement of the piston means causing discharge of fluid from the dispenser as said actuating means is operated.

5. In a fluid dispenser in accordance with claim 3, resilient means for normally urging said variable length means to said maximum longitudinal extension such that said first and second parts are normally urged into closing relation with said discharge and vent openings and said operation of the actuating means causes said first and second parts to move against the urgency of said resilient means out of closing relation with said openings.

6. In a fluid dispenser in accordance with claim 1, said actuating means being manually movable from said first to said second position by the application of operator finger pressure to said actuating means and further comprising means for returning said actuating means to said first position upon release of said operator finger pressure.

7. In a fluid dispenser in accordance with claim 6, wherein said actuating means is manually movable from said first toward said second position by an operator-selectable amount, said manual movement of the actuating means causing corresponding foreshortening of said variable length means by an amount directly related to the operator-selected manual movement of said actuating means for discharging from said dispenser a controlled amount of stored fluid determined by the operator-selected manual movement of said actuator means.

8. In a fluid dispenser in accordance with claim 7, piston means bounding an end of said fluid storage interior space remote from said discharge opening and operatively associated with said variable length means for movement along said housing toward said discharge opening as said variable length means is foreshortened by said operator-selected manual movement of said actuator means so that said movement of the piston means toward said discharge opening decreases the volume of said interior space and causes discharge of stored fluid from said dispenser through said discharge opening.

9. In a fluid dispenser in accordance with claim 8, said piston means including means for preventing movement of said piston means along said housing in a direction away from said discharge opening.

10. In a fluid dispenser in accordance with claim 8, said variable length means comprising a first part normally urged into closing relation with said discharge opening and movable by operation of said actuating means away from said discharge opening to permit discharge of stored fluid through said discharge opening, and a second part normally urged into closing relation with said vent opening and movable by operation of said actuating means away from said vent opening concurrently with said movement of the first part of said variable length means.

11. In a fluid dispenser in accordance with claim 10, said piston means being operatively associated for movement toward said discharge opening with said second part of said variable length means.

12. In a fluid dispenser in accordance with claim 11, said piston means including means for preventing movement of said piston means along said housing in a direction away from said discharge opening.

13. In a fluid dispenser in accordance with claim 1, said actuating means including a portion movable between first and second positions and further comprising diaphragm means deformable by said movement of the actuating means portion for increasing the pressure in said fluid storage space as the actuating means is operatively moved from said first to said second position so as to cause a discharge of stored fluid from said space through said discharge opening when said discharge opening is opened by said foreshortening of said variable length means.

14. In a fluid dispenser in accordance with claim 1, a cap removably disposable over the end of said housing proximate said discharge opening during periods of nonuse of said dispenser, said actuating means including locking means cooperatively engageable with said cap for preventing movement of said actuating means from said first to said second position and thereby preventing discharge of stored fluid from said dispenser when said cap is disposed over the end of said housing.

15. In a fluid dispenser in accordance with claim 1, said actuating means being movable between said first and said second positions in a direction substantially perpendicular to said elongation of the dispenser housing.

16. In a fluid dispenser in accordance with claim 1, said actuating means being movable between said first and said second positions in a direction substantially perpendicular to the direction of said foreshortening of said variable length means.

17. In a fluid dispenser in accordance with claim 13, said actuating means portion comprising pushbutton means manually-movable from said first to said second position by application of operator finger pressure to said pushbutton for deforming said diaphragm means, and driving means movable by said movement of said pushbutton and diaphragm means for causing said foreshortening of said variable length means from said maximum longitudinal extension as said pushbutton means is moved from said first toward said second position.

18. In a fluid dispenser in accordance with claim 10, wherein said first part of said variable length means includes an operating surface tapered in a first direction and said second part of said variable length means includes an operating surface tapered in a second direction, said actuating means including a tapered portion movably engageable with said operating surfaces of said first and second parts for causing said first and second parts to move away from said discharge and vent openings as said actuating means is operatively moved from said first to said second position.

19. In a fluid dispenser in accordance with claim 18, said operating surfaces of said first and second parts being tapered in opposite directions.

20. In a fluid dispenser in accordance with claim 1, applicator means carried on the end of said housing proximate said discharge opening for receiving fluid discharged through said discharge opening in the dispenser.

21. In a fluid dispenser in accordance with claim 20, said applicator means comprising a brush.

22. In a fluid dispenser in accordance with claim 20, cap means removably engageable with the end of said housing proximate said discharge opening for covering and enclosing said applicator means during periods of nonuse of the dispenser.

23. In a fluid dispenser in accordance with claim 22, said cap means comprising a cap housing and shuttle means in said cap housing for receiving said applicator means and engageable with said dispenser housing end proximate the discharge opening, said shuttle means being movable within said cap housing between a first position when said dispenser housing and a second position when said cap means is fully engaged with said dispenser housing and for enclosing said applicator means.

24. In a fluid dispenser in accordance with claim 23, said actuating means further comprising locking means engageable with said cap means for preventing movement of said actuating means from said first to said second position of said actuating means when said cap means is fully engaged with said dispenser housing end.

25. In a fluid dispenser in accordance with claim 22, said variable length means further comprising locking means movably engageable with said cap means for preventing movement of said actuating means from said first to said second position when said cap means is fully engaged with said dispenser housing end.

26. In a fluid dispenser in accordance with claim 3, said variable length means further comprising spring means for returning said first and second parts to said initial position of maximum longitudinal extension after operative movement of said actuating means from said fist to said second position.

27. In a manually-operable fluid dispenser for discharging an internally-stored fluid in response to user actuation, an elongated housing having an opening defined proximate a fluid discharge end of the dispenser;

actuating means manually-operable for initiating discharge of a predetermined volume of stored fluid through said opening and including plunger means for user-effected manual movement from a first to a second position; and reciprocatable means movable longitudinally along said housing in response to operation of said actuating means for causing a discharge of fluid from said dispenser, said reciprocatable means comprising first and second members extending longitudinally along said housing and normally fluid-tightly closing said opening, said first and second members being engageable with said plunger means such that, as said plunger means moves from said first and said second position, it concurrently drives said first and said second members in respectively opposite longitudinal directions to open said opening and permit a discharge of internally-stored fluid through said opening from the dispenser.

28. In a dispenser in accordance with claim 27, said first member being disposed for normally fluid-tight closing engagement with said opening and being drivable by said movement of the plunger means from said first to said second position to retract said first member from said engagement with the opening and thereby open said opening and permit a discharge of fluid therethrough.

29. In a dispenser in accordance with claim 28, piston means operatively coupled for corresponding movement with said second member as said second member is driven by said plunger means so as to force stored fluid toward said opening for discharge therethrough as said opening is opened by concurrent retraction of said first member.

30. In a dispenser in accordance with claim 28, a vent opening defined proximate a distal end of said housing opposite said discharge end thereof, and said second member being disposed for normally fluid-tight closing engagement with said vent opening and being drivable by said movement of the plunger means from said first to said second position to retract said second member from closing engagement with said vent opening and thereby open said vent opening.

31. In a dispenser in accordance with claim 30, said plunger means being operatively engaged with said first and second members so that, as said plunger means is increasingly manually moved from said first toward second position, said first and second members are correspondingly increasingly driven in said respectively opposite directions to correspondingly increasingly open said fluid discharge and vent openings and thereby effect a discharge of a controllable volume of stored fluid through said discharge opening.

32. In a dispenser in accordance with claim 30, said plunger means being movable substantially radially into said housing from said first to said second position, and said operative engagement of said plunger means with said first and second members effecting a direct mechanical conversion of radially-inward movement t longitudinally-directed reciprocation of said first and second members in respectively opposite directions as said plunger means is manually driven from said first to said second positions.

33. In a dispenser in accordance with claim 30, return means on at least one of said actuating means and said reciprocatable means for automatically returning said reciprocatable means to said normal position thereof and said plunger means to said first position thereof following manually-effected user operation of said actuating means and discharge of internally-stored fluid through said discharge opening.

34. In a manually-operable fluid dispenser for discharging an internally-stored fluid in response to user actuation, an elongated housing having a fluid discharge opening defined proximate a forward end of the housing;

a reservoir in said housing for containing a supply of stored fluid dischargeable through said opening;

piston means movable longitudinally along said housing toward said housing forward end for driving stored fluid in said reservoir toward said discharge opening;

actuator means manually advanceable into said housing by user manipulation; and dual action operating means for effecting a discharge of stored fluid through said opening in response to user-manipulated advance of said actuator means, said operating means comprising first and second members extending and movable longitudinally along said housing, said first member being releasably engageable with said discharge opening for normally fluid-tightly closing said opening and said second member being releasably coupled with said piston means for moving said piston means toward said housing forward end, and said first and second members being engaged with said actuator means so that user-manipulated advance of said actuator means directly and concurrently drives said first and second members through a longitudinal movement in respectively opposite directions along said housing to open said discharge opening by retraction of said first member from engagement with said opening and to carry said piston means longitudinally toward said housing forward end whereby a volume of stored fluid in said reservoir is driven toward and through said opening and is thereby discharged from said dispenser in response to said user-manipulated advance of said actuator means.

35. In a dispenser in accordance with claim 34 wherein said actuating means is manually advanceable into said housing to a selectively variable user-controlled depth, the amount of said longitudinal movement of said first and second members in respectively opposite directions along said housing in response to user-manipulated advance of said actuator means being directly proportional to the user-controlled depth of said actuating means advance thereby providing selective user control of the volume of stored fluid operatively discharged from the dispenser.

36. In a dispenser in accordance with claim 34, said housing further having a vent opening defined proximate a distal end of the housing opposite said housing forward end, and said second member being releasably engageable with said vent opening for normally fluid-tightly closing said vent opening and for retraction from engagement with said vent opening as said second member is longitudinally moved in directly driven response to said user-manipulated advance of said actuator means.

37. In a manually-operable fluid dispenser for discharging an internally-stored fluid in response to user actuation, an elongated housing having a fluid discharge opening defined proximate a forward end of the housing;

a reservoir in said housing for containing a supply of stored fluid dischargeable through said opening;

actuator means on said housing for user-manipulated radially-inwardly directed movement;

dual action concurrently bidirectional operating means arranged for longitudinal movement along said housing and having a first part releasably engaging said discharge opening for normally fluid-tightly closing said opening and a second part bounding and end of said reservoir remote from said housing forward end; and means mechanically connecting said actuator and operating means for converting said radially-inwardly directed movement of said actuator means to longitudianl movement of said operating means such that, in response to said user-manipulated actuator means movement, said operating means second part is directly driven toward said housing forward end and said operating means first part is concurrently directly driven away from said housing forward end to retract said first part from engagement with said opening and thereby permit a discharge of stored fluid driven by said second part through said opening.

38. In a dispenser in accordance with claim 37, said housing further including a vent opening defined proximate a distal end of the housing opposite said housing forward end, and said operating means second part being releasably engageable with said vent opening for normally fluid-tightly closing said vent opening and for retraction from engagement with said vent opening as said second part is directly driven toward said housing forward end in response to said user-manipulated radially-inwardly directed movement of said actuator means.

* * * * *